US008170179B2

(12) United States Patent
Hertz et al.

(10) Patent No.: US 8,170,179 B2
(45) Date of Patent: May 1, 2012

(54) DEBRIS REDUCTION IN ELECTRON-IMPACT X-RAY SOURCES

(75) Inventors: Hans M. Hertz, Stockholm (SE); Mikael Otendal, Solna (SE); Tomi Tuohimaa, Stockholm (SE)

(73) Assignee: Jettec AB, Stocksund (SE)

( * ) Notice: Subject to any disclaimer, the term of this patent is extended or adjusted under 35 U.S.C. 154(b) by 0 days.

(21) Appl. No.: 12/227,230

(22) PCT Filed: May 8, 2007

(86) PCT No.: PCT/SE2007/000448

§ 371 (c)(1), (2), (4) Date: Feb. 12, 2009

(87) PCT Pub. No.: WO2007/133144

PCT Pub. Date: Nov. 22, 2007

(65) Prior Publication Data

US 2009/0141864 A1 Jun. 4, 2009

(30) Foreign Application Priority Data

May 11, 2006 (SE) ..... 0601048

(51) Int. Cl.

| | |
|---|---|
| ***H01J 35/16*** | (2006.01) |
| ***H01J 35/08*** | (2006.01) |
| ***G21G 4/00*** | (2006.01) |
| ***G21G 4/06*** | (2006.01) |

(52) U.S. Cl. ..... 378/119; 378/143; 250/493.1

(58) Field of Classification Search ..... 378/119, 378/121, 143, 201; 250/493.1; 313/231.31, 313/567

See application file for complete search history.

(56) References Cited

U.S. PATENT DOCUMENTS

| | | | | |
|---|---|---|---|---|
| 2,665,390 | A * | 1/1954 | Zunick et al. | 378/141 |
| 4,953,191 | A * | 8/1990 | Smither et al. | 378/143 |
| 5,052,034 | A * | 9/1991 | Schuster | 378/121 |
| 6,359,968 | B1 * | 3/2002 | Harding | 378/143 |
| 6,760,406 | B2 * | 7/2004 | Hertz et al. | 378/119 |
| 6,995,382 | B2 * | 2/2006 | Ziener et al. | 250/504 R |
| 7,515,688 | B2 * | 4/2009 | Harding | 378/143 |
| 2002/0015473 | A1 * | 2/2002 | Hertz et al. | 378/143 |
| 2002/0048345 | A1 * | 4/2002 | Bachmann et al. | 378/121 |
| 2002/0080919 | A1 | 6/2002 | Harding et al. | |
| 2003/0219097 | A1 * | 11/2003 | Buijsse | 378/43 |
| 2005/0175153 | A1 * | 8/2005 | Harding et al. | 378/143 |

FOREIGN PATENT DOCUMENTS

WO WO-03/096764 A1 11/2003

OTHER PUBLICATIONS

Hemberg, O et al., Applied Physics Letters, Aug. 18, 2003, vol. 83, issue 7, pp. 1483-1485.

* cited by examiner

*Primary Examiner* — Anastasia Midkiff

(74) *Attorney, Agent, or Firm* — Birch, Stewart, Kolasch & Birch, LLP

(57) ABSTRACT

A method for generating x-ray radiation, comprising the steps of forming a target jet by urging a liquid substance under pressure through an outlet opening, the target jet propagating through an area of interaction; and directing at least one electron beam onto the target jet in the area of interaction such that the electron beam interacts with the target jet to generate x-ray radiation; wherein the full width at half maximum of the electron beam in the transverse direction of the target jet is about 50% or less of the target jet transverse dimension. A system for carrying out the method is also disclosed.

45 Claims, 2 Drawing Sheets

DEBRIS REDUCTION IN ELECTRON-IMPACT X-RAY SOURCES

TECHNICAL FIELD

The inventive improvements disclosed herein generally relate to electron-impact x-ray sources. More particularly, the disclosure is directed to the reduction of debris and improvement of x-ray brightness in electron-impact x-ray sources having a liquid-jet anode.

TECHNICAL BACKGROUND

X-rays have been used for imaging ever since the discovery thereof by Roentgen at the turn of the 19th century. Since available x-ray optics are severely limited, x-ray imaging is still mostly based on absorption shadow-graphs. This is basically true even for modern Computer Tomography (CT) imaging and, as a consequence, the brightness of the x-ray source is a figure of merit limiting both the exposure time and the attainable resolution in many applications.

Today x-ray imaging is a widespread and standard method in science, medicine and industry. Although well established, there are numerous applications that would greatly benefit from an increased brightness. Among these are applications in medicine requiring high spatial resolution, such as mammography and angiography, and emerging techniques requiring monochromatic radiation which currently can not be achieved with reasonable exposure times. Also, certain protein crystallography, today only possible at synchrotron radiation facilities, may be feasible with a compact source. Furthermore, a significant increase in the brightness of compact x-ray sources could enable phase imaging with reasonable exposure times. This is important since the phase contrast is often much higher than the absorption contrast. In addition, phase contrast imaging could reduce the absorbed dose during imaging.

The basic physics relied upon for x-ray production in compact electron-impact sources has been the same since the days of Roentgen. As the electrons impact the target they lose energy in one of two ways: either they can be decelerated in the electric field close to an atomic nucleus and emit continuous bremsstrahlung radiation, or they can knock out an inner-shell electron, resulting in the emission of a characteristic x-ray photon when the vacancy is filled. The efficiency of x-ray production by electron impact is very poor, typically below 1%, and the bulk of the energy carried by the electron beam is converted to heat.

The brightness of current state-of-the-art compact electron-impact x-ray sources is limited by thermal effects in the anode. The x-ray spectral brightness [i.e. photons/($mm^2$·sr·s·BW), where BW stands for bandwidth] is proportional to the effective electron-beam power density at the anode, which must be limited not to melt or otherwise damage the anode. Since the first cathode-ray tubes only two fundamental techniques, the line focus and the rotating anode, have been introduced to improve the power load capacity of the anode.

The line focus principle, introduced in the 1920s, utilizes the fact that the x-ray emission is non-Lambertian to increase the effective power load capacity by extending the targeted area but keeping the apparent source area almost constant by viewing the anode at an angle. Ignoring the Heel-effect and field of view, this trick increases the attainable power load capability by up to ~10×. The rotating anode was introduced in the 1930s to further extend the effective electron-beam-heated area by rotating a cone-shaped anode to continuously provide a cool target surface.

After these improvements, progress with respect to brightness has been rather slow for compact electron-impact sources and has only been due to engineering perfection in terms of target material, heat conduction, heat storage, speed of rotation etc. Current state-of-the-art sources now allow for 100-150 kW/$mm^2$ effective electron-beam power density. Typical high-end implementations are, e.g., 10 kW, 0.3×0.3 $mm^2$ effective x-ray spot size angiography systems and 1.5 kW, 0.1×0.1 $mm^2$ effective x-ray spot size fine-focus mammography systems. Low-power micro-focus sources (4 W, 5 μm effective x-ray spot diameter) have similar effective power densities (200 kW/$mm^2$) and are also limited by thermal effects.

The power load limit of a modern rotating anode can be calculated by $$\frac{P}{A_{effective}} = \frac{\pi l(T_{max} - \Delta T_{margin} - T_{base})\sqrt{\lambda \rho c_p f R \delta}}{4\delta^2\left(1 + k\sqrt{tf\frac{\delta}{\pi R}}\right)}, \quad (1)$$

where $A_{effective}$ is the apparent x-ray source area, R is the anode radius, l is the spot height, 2δ is the spot width, $T_{max}$ is the maximum permissible temperature before breakdown, $\Delta T_{margin}$ is a safety margin, $T_{base}$ is the anode starting temperature, λ is the thermal conductivity, ρ is the density, $c_p$ is the specific heat capacity, f is the rotation frequency, t is the load period, and k is a correction factor taking into account radial heat conduction, heat loss by radiation and anode thickness. As can be seen from Eq. 1, the only way to increase the power load limit is to increase the spot speed, i.e., f and R. Unfortunately even a quite unrealistic set of parameters (1 m diameter anode and 1 kHz rotation) would only increase the output flux ~6×. It therefore seems unlikely that conventional x-ray source technology can be developed much further, even with significant engineering efforts.

A way to increase the brightness in compact electron-impact based hard-x-ray sources would be a fundamentally different anode configuration allowing a higher electron-beam power density. To this end, there has previously been reported a new liquid-metal-jet anode concept. This anode configuration could allow a significantly higher (>100×) thermal load per area than current state of the art due to fundamentally different thermal limitations, as explained below. Liquid-jet systems have been extensively used as targets in negligible-debris laser-produced plasma soft x-ray and EUV sources. A liquid-gallium jet has also been used as target in hard x-ray production in femto-second laser-plasma experiments. Furthermore, an electron beam has been combined with a water jet for low power soft x-ray generation via fluorescence. X-ray tubes with liquid anodes, either stationary or flowing over surfaces, have previously been reported but their advantages for high-brightness operation are limited due to the intrinsically low flow speed and cooling capacity of such systems. Recent work also includes a liquid anode flowing behind a thin window.

The much higher power-density capacity of liquid-metal-jet systems compared to conventional anodes (2-3 orders of magnitude or more) is, in brief, due to three main reasons: (i) different thermal properties of the liquid-jet anode compared to a solid anode, (ii) the potential for higher jet speeds than what is possible for a rotating anode, and (iii) the regenerative nature of the liquid jet, which makes the requirement of keeping the anode intact more relaxed.

However, when attempting to increase the power for such systems, emission of debris is a potential practical difficulty. Hence, improvements are called for to reduce the debris issue for liquid-jet anode x-ray sources.

SUMMARY

In short, it is proposed herein a method for generating x-ray radiation, which is characterized in that the full width at half maximum of the electron beam in the transverse direction of the target jet is about 50% of the target jet transverse dimension or less. It has now been discovered that this results in a considerable shielding effect of the very hot electron-beam impact area on the target jet, thus advantageously reducing the amount of debris produced. In addition, the further technical effect is obtained that the effective power density is increased when the x-ray spot is viewed from the side. This latter is in analogy with the line focus principle described in the introduction.

Hence, the inventive principles disclosed herein have the attractive advantage that reduction of debris can be obtained without significantly increasing the target-jet propagation speed, but rather by employing an electron beam having, at impact on the target, a full width at half maximum (FWHM) which is about half the transverse dimension of the target jet or less. By employing an electron beam which is considerably smaller than the transverse dimension of the target jet, the target jet will give rise to a shielding effect which limits the amount of produced debris in an advantageous manner.

The inventive principles also extend to a system for generating x-ray radiation, said system comprising means for carrying out the method.

It should be understood that the size (FWHM) of the electron beam at impact upon the target jet could be slightly larger than 50% of the target jet transverse dimension and still produce the inventive shielding effect.

Suitably, the generated x-ray radiation could be used in applications such as imaging, medical applications, crystallography, x-ray microscopy, proximity or projection lithography, photoelectron spectroscopy or x-ray fluorescence, to name a few.

DETAILED DESCRIPTION

Figure 1:
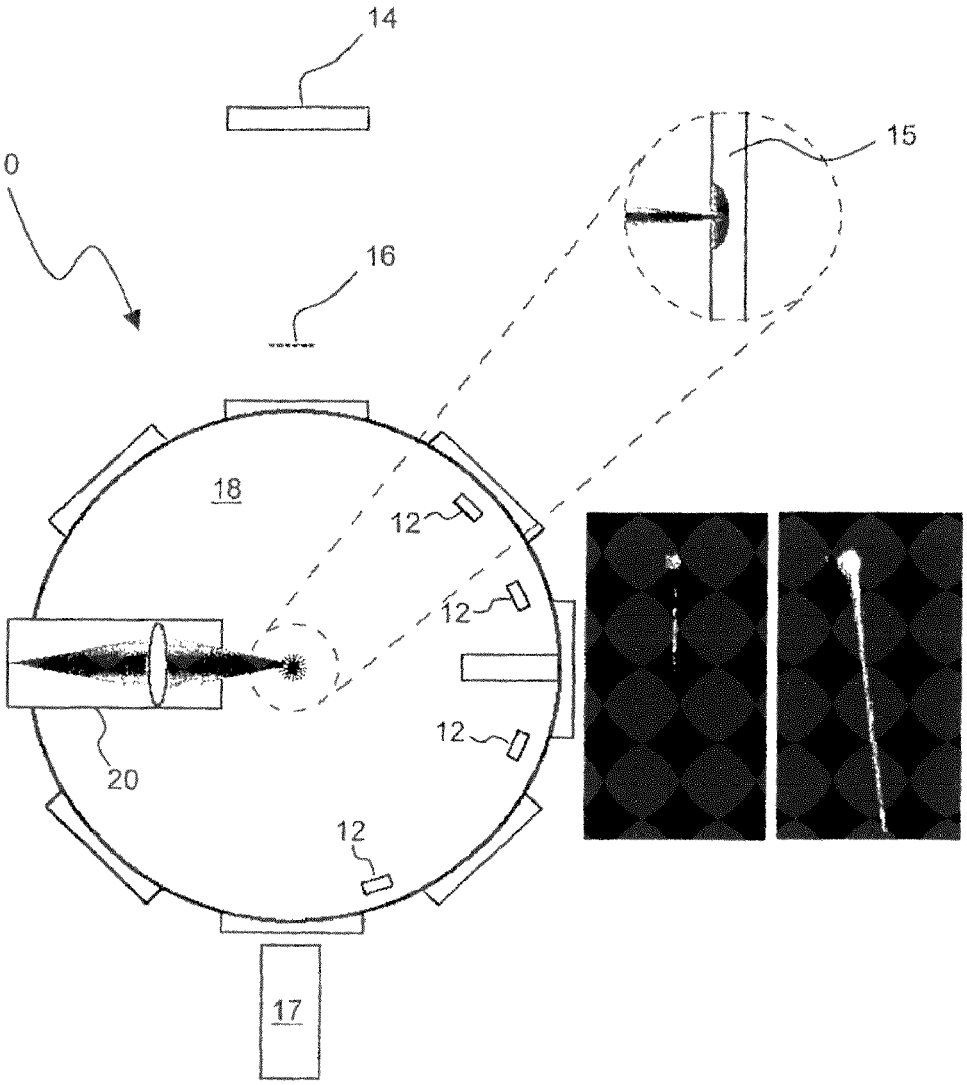
FIG. 1 shows schematically a set-up for the inventive liquid-metal-jet x-ray source viewed from above. The photo inserts show a metal jet during low-power operation (left photo) and high-power operation (right photo).

FIG. 1 shows the experimental arrangement of the liquid-metal-jet x-ray source, i.e. a system 10 for generating x-ray radiation according to the present invention. A liquid-metal jet 15 consisting of 99.8% tin is injected through a 30-μm or 50-μm diameter glass capillary nozzle into an evacuated chamber 18. Jet speeds of up to 60 m/s can be achieved by applying 200 bars of nitrogen pressure over the molten tin. The speed of the target jet is, thus, comparable to the fastest rotating anodes. The electron-beam system 20 is based on a 600 W (50 kV, 12 mA) e-beam gun in continuous operation. The e-beam is focused by a magnetic lens into a ~15 or ~25 μm full-width-at half-maximum (FWHM) diameter spot depending on the size of the $LaB_6$ cathode (50 μm or 200 μm diameter). The e-gun is pumped with a separate 250 l/s turbo-drag pump, and the apertures at the ends of the magnetic lens are small enough to maintain a sufficient differential pressure between the main vacuum chamber (~$10^{-4}$ mbar) and the electron gun (~$10^{-7}$ mbar). However, as will be understood, the pump may be omitted in some embodiments. The cathode is shielded from tin vapor by a 1 mm diameter hole in a 120 μm thick aluminum foil, which is placed between the jet and the magnetic lens. The vacuum around the cathode is kept in the low $10^{-7}$ mbar range even during high-power operation of the gun resulting in a reasonable lifetime (>1000 h) for the $LaB_6$ cathode. Debris witness plates 12 are placed at four different positions in the main tank about 150 mm from the x-ray source. For x-ray imaging we use a 4008×2672 pixel phosphor-coated CCD detector 14 with 9 μm pixels and a measured point-spread function (PSF) of ~34 μm FWHM. A gold mammography resolution object 16 (20 μm thick gold with 25 μm wide lines and spaces) is placed 50 mm from the source and 190 mm in front of the CCD. A 12× zoom microscope 17 is used for optical inspection of the jet.

Figure 2:
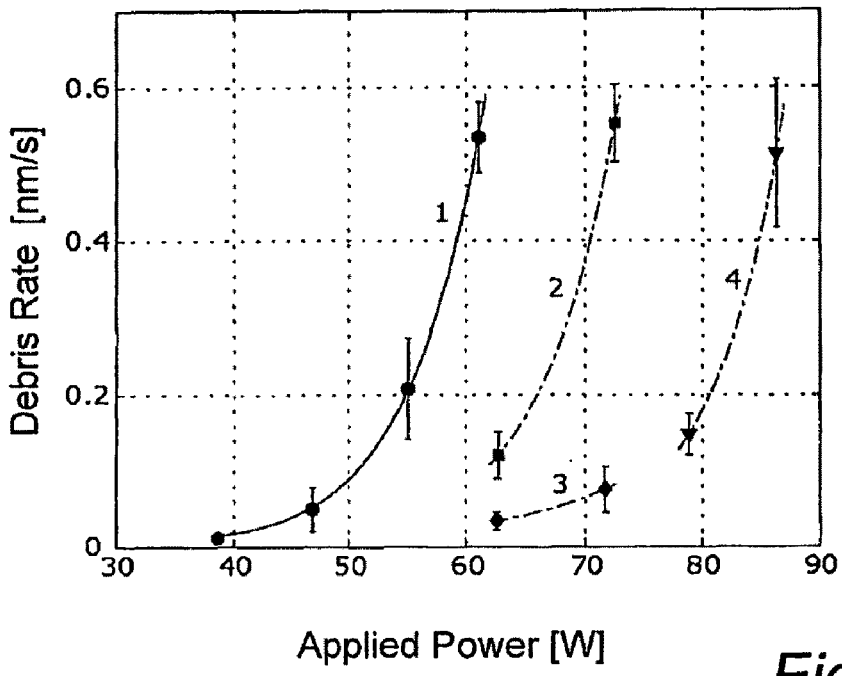
FIG. 2 is a graph showing debris emission rates as a function of the applied electron-beam power and electron-beam focus spot. The error bars indicate standard deviation.

Experiments were carried out in order to evaluate the inventive principle of producing x-rays. Debris deposition rates for several different system parameters were studied: an e-beam power between 38 W and 86 W, a jet speed of 22 or 40 m/s, a 30 or 50 μm jet diameter, and an e-beam focus of 15 or 26 μm. The witness plates 12 were exposed to tin vapor for 6-24 minutes and analyzed with a surface profilometer (KLA Tencor P-15). FIG. 2 shows the results. Curve 1 (22 m/s, 30 μm diameter jet, 24±2 μm diameter spot) shows that the debris deposition rate is exponentially dependent on the power applied on the jet, which is in agreement with the increasing vapor pressure of tin as a function of temperature. Curve 2 depicts the debris emission from a 22 m/s, 50 μm diameter jet with a 24±2 μm spot. By comparing Curves 1 and 2 it should be noted that an increased jet diameter leads to a decreased debris emission rate. This is believed to be due to two reasons: (i) the increased mass flow of the larger jet leads to a reduced average temperature of the jet and, thus, a reduced evaporation rate, and (ii) increasing the jet diameter, but keeping the size of the e-beam constant, results in a more effective shielding of the very hot electron-beam impact area on the jet as seen from the debris witness plates. It should be noted that the same effect could be obtained generally by increasing the jet size to e-beam size ratio. It has been found particularly advantageous to have an e-beam size that is 50% or less compared to the jet size. Curve 3 provides further evidence for the shielding concept. Curve 3 has the same jet parameters as Curve 2 but the x-ray spot is smaller (15.5±1.5 μm FWHM), clearly resulting in improved shielding. At the applied power of 72 W the smaller focus yielded a reduction of the debris emission rate by a factor of ~16× compared to the 24±2 μm operation. Finally, Curve 4 shows the impact on the debris rate of an increased target speed (40 m/s, 30 μm diameter jet, 24±2 μm spot). An ~80% increase of the jet velocity in combination with a ~50% increase of the applied power resulted in the same rate of debris emission.

The debris rates will naturally increase when higher-brightness operation is attempted by increasing the e-beam power and power density. We note that for sub-kW e-beam guns, the technological e-beam power density limit due to the cathode emissivity is a few tens of $MW/mm^2$, i.e. two orders of magnitude above the highest power density of the metal-jet anode reported here. A significant improvement of the power density capacity of the jet anode may be achieved by having a much faster jet, and it has, in fact, been shown that it should be possible to produce stable tin jets at speeds up to at least ~500 m/s. On the other hand, this may not necessarily be the only way to modify the jet for reduced debris production. As is indicated by the results in FIG. 2, and in accordance with the inventive principles disclosed herein, a medium-speed jet with a larger diameter (compared to the e-beam) may prove to have better debris reduction properties than considerably faster, but thinner, jets (cf. curves 3 and 4).

Figure 3:
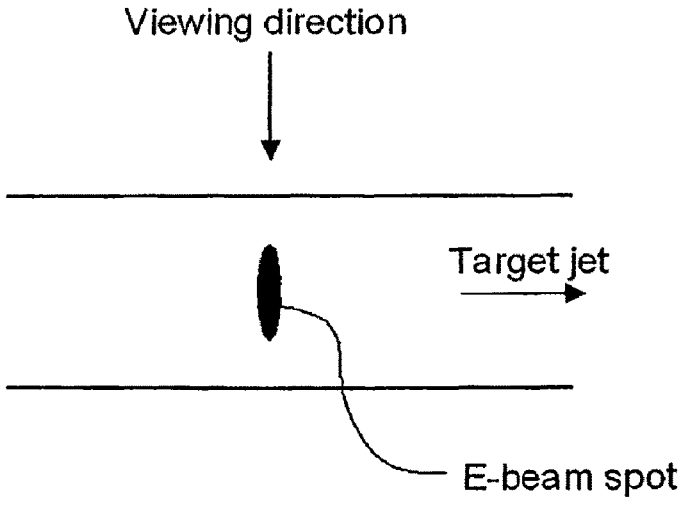
FIG. 3 is a schematic drawing showing the use of an elliptic or line focus for the electron beam.

It should be noted that the spot of the electron beam on the target jet may be circular, elliptical or a line focus as desired. For example, and as shown in FIG. 3, it may be preferred to use an elliptic electron beam spot (a line focus)—having its major axis transverse to the longitudinal extension of the target jet and having, as suggested and claimed herein, a FWHM along the major axis which is about 50% or less of the target jet diameter. According to the well known line focus principle, this will give increased effective power load capacity for the target without sacrificing the brightness of the x-ray source when the targeted area is viewed from the side.

However, when an elongated electron beam spot is used according to the above, it is not required that the extension thereof is transverse to the target jet. Any general orientation of the elliptic or line focused electron beam spot is conceivable, and an effective increase of the x-ray brightness may be obtained by viewing (collecting) the generated x-ray from an appropriate angle. For example, if an electron beam spot is used having a line focus extending generally along the target jet, increased x-ray brightness may be obtained by viewing the spot from a slanting angle along the target jet.

Moreover, it should be pointed out that the line focus principle may be used also when a circular electron beam spot is utilized. The reason is the following. When the electron beam impacts on the target jet, x-ray radiation will typically be generated within the first few microns of target material as the electrons penetrate the target jet. As a non-limiting example, the electrons may typically penetrate about 4 microns into the target material. This is schematically shown in the enlarged side view of FIG. 1. Hence, when viewed from the side, as shown in FIG. 1, the x-ray radiation will be generated in a region having an elongated profile of only a few microns width. As a practical example, consider a circular electron beam spot having a size (FWHM) of 50 microns which impacts upon a target jet of about 100 microns diameter. This will produce an x-ray region (or "volume") in the target jet roughly resembling a cylinder having a diameter of 50 microns and a "height" of slightly more than 4 microns (due to the curvature of the target jet surface). If this x-ray region is viewed along the electron beam, the apparent x-ray spot will be a circle of 50 microns diameter. However, when the same x-ray region is viewed from the side, it will have the general shape of an elongated area having a length of about 50 microns and a width of slightly more than 4 microns, i.e. a radical decrease of the apparent area resulting in improved brightness for the x-ray source from this viewing direction. Hence, it may be preferred to collect the generated x-ray emission from a direction that is at an angle with respect to the electron beam. For example, if the target jet propagation direction and the electron beam propagation direction are at right angles with respect to each other, then the brightness of the x-ray source may be maximized by collecting the generated radiation from a direction that is at a right angle to the electron beam.

The principle of using a reduced-size electron beam in order to reduce debris may advantageously be combined with prior-art techniques for reducing debris, such as increased jet-propagation speed, debris mitigation systems, etc.

The target jet may be electrically conductive or non-conductive. For example, the target jet may comprise a metal (e.g. tin or gallium), a metal alloy or a low melting-point alloy, a cryogenic gas or any other liquid substance suitable as a target for electron-impact x-ray sources.

It should also be understood that the target jet may have any cross-sectional shape, for example circular, rectangular or elliptical.

Typical diameters for the target jet are from about 10 μm to about 100 μm, such as 30 μm or 50 μm. However, in some applications even larger target jet cross-sections are conceivable. The propagation speed of the target jet in the area of interaction can be up to about 500 m/s, and typical values are from about 20 m/s to about 60 m/s. As will be understood, an increase in propagation speed for the target jet will lead to an improved power density capacity of the jet anode.

It will be understood that the examples given above are only for illustrative and enabling purposes, not intended to limit the scope of the invention. The scope of the invention is defined by the appended claims.

The invention claimed is:

1. A method for generating x-ray radiation, comprising the steps of:

forming a target jet by urging a liquid metal under pressure through an outlet opening into an evacuated chamber, the target jet propagating through an area of interaction, and directing at least one electron beam onto the target jet in the area of interaction such that the electron beam interacts with the target jet to generate x-ray radiation, said electron beam having a power of at least 38 W;

wherein the full width at half maximum of the electron beam is about 50% or less of at least one target jet transverse dimension, and is less than any other target jet transverse dimension, such that a debris shielding effect is obtained.

2. The method of claim 1, wherein the electron beam is directed onto the target jet in a line focus.

3. The method of claim 1 or 2, wherein the target jet propagation speed in the area of interaction is about 20-60 m/s.

4. The method of claim 1, further comprising the step of collecting the generated x-ray radiation from a direction at an angle with respect to the electron beam.

5. The method of claim 4, wherein the generated x-ray radiation is collected from a direction at a right angle with respect to the electron beam.

6. The method of claim 1, wherein the liquid metal forming the target jet is an alloy or a low melting-point alloy.

7. The method of claim 1, wherein the liquid metal forming the target jet is liquid at room temperature and atmospheric pressure.

8. The method of claim 1, wherein the target jet forms an anode for the electron beam.

9. The method of claim 1, further comprising the step of using the generated x-ray radiation for imaging.

10. The method of claim 1, further comprising the step of using the generated x-ray radiation for x-ray microscopy.

11. The method of claim 1, further comprising the step of using the generated x-ray radiation for proximity or projection lithography.

12. The method of claim 1, further comprising the step of using the generated x-ray radiation for photoelectron spectroscopy.

13. The method of claim 1, further comprising the step of using the generated x-ray radiation for x-ray fluorescence.

14. The method of claim 1, further comprising the step of using the generated x-ray radiation for crystallography.

15. A system for generating x-ray radiation, comprising a jet unit for forming a target jet by urging a liquid metal under pressure through an outlet opening into an evacuated chamber, such that the target jet propagates through an area of interaction, and an electron beam unit for directing at least one electron beam having a power of at least 38 W onto the target jet in the area of interaction, such that the electron beam interacts with the target jet to generate x-ray radiation;

wherein the jet unit for forming the target jet and the electron beam unit for directing at least one electron beam onto the target jet are arranged such that the full width at half maximum of the electron beam is about 50% or less of at least one target jet transverse dimension, and is less than any other target jet transverse dimension, such that a debris shielding effect is obtained.

16. A method for generating x-ray radiation, comprising the steps of:

forming a target jet by urging a liquid metal under pressure through an outlet opening into an evacuated chamber, the target jet propagating through an area of interaction, and directing at least one electron beam onto the target jet in the area of interaction such that the electron beam interacts with the target jet to generate x-ray radiation, said electron beam having a power of at least 63 W;

wherein the full width at half maximum of the electron beam is about 50% or less of at least one target jet transverse dimension, and is less than any other target jet transverse dimension, such that a debris shielding effect is obtained.

17. A system for generating x-ray radiation, comprising a jet unit for forming a target jet by urging a liquid metal under pressure through an outlet opening into an evacuated chamber, such that the target jet propagates through an area of interaction, and an electron beam unit for directing at least one electron beam having a power of at least 63 W onto the target jet in the area of interaction, such that the electron beam interacts with the target jet to generate x-ray radiation;

wherein the jet unit for forming the target jet and the electron beam unit for directing at least one electron beam onto the target jet are arranged such that the full width at half maximum of the electron beam is about 50% or less of at least one target jet transverse dimension, and is less than any other target jet transverse dimension, such that a debris shielding effect is obtained.

18. The method of claim 1, wherein the full width at half maximum of the electron beam is about 50% or less of the target jet transverse dimensions in all transverse dimensions.

19. The method of claim 1, wherein an increase in the target jet diameter decreases a debris emission rate.

20. The method of claim 1, wherein the target jet has a transverse diameter in a range from 10 μm to 100 μm.

21. The method of claim 1, wherein a propagation speed of the target jet in the area of interaction with the electron beam is about 500 m/s or lower.

22. The method of claim 1, wherein a propagation speed of the target jet in the area of interaction with the electron beam is between 20 m/s and 60 m/s.

23. The method of claim 1, wherein the target jet has a transverse diameter of 50 μm and the full width at half maximum of the electron beam is 24±2 μm, and the electron beam has a power of at least 63 W.

24. The method of claim 1, wherein the target jet has a transverse diameter of 50 μm and the full width at half maximum of the electron beam is 24±2 μm, and the electron beam has a power of 63 W.

25. The method of claim 1, wherein the target jet has a transverse diameter of 50 μm and the full width at half maximum of the electron beam is 24±2 μm, and the electron beam has a power of 72 W.

26. The method of claim 1, wherein the target jet has a transverse diameter of 50 μm and the full width at half maximum of the electron beam is 15.5±1.5 μm, and the electron beam has a power of 63 W.

27. The method of claim 1. wherein the target jet has a transverse diameter of 50 μm and the full width at half maximum of the electron beam is 15.5±1.5 μm, and the electron beam has a power of 72 W.

28. The method of claim 1, wherein the target jet has a transverse diameter of 30 μm and the electron beam has a power of 55 W.

29. The method of claim 1, wherein the target jet has a transverse diameter of 30 μm and the electron beam has a power of 38 W.

30. The method of claim 1, wherein the target jet has a transverse diameter of 30 μm and the electron beam has a power of 47 W.

31. The method of claim 1, wherein the target jet has a transverse diameter of 30 μm and the electron beam has a power of 78.5 W.

32. The system for generating x-ray radiation of claim 15, wherein the full width at half maximum of the electron beam is about 50% or less of the target jet transverse dimensions in all transverse dimensions.

33. The system for generating x-ray radiation of claim 15, wherein an increase in the target jet diameter decreases a debris emission rate.

34. The system for generating x-ray radiation of claim 15, wherein the target jet has a transverse diameter in a range from 10 μm to 100 μm.

35. The system for generating x-ray radiation of claim 15, wherein a propagation speed of the target jet in the area of interaction with the electron beam is about 500 m/s or lower.

36. The system for generating x-ray radiation of claim 15, wherein a propagation speed of the target jet in the area of interaction with the electron beam is between 20 m/s and 60 m/s.

37. The system for generating x-ray radiation of claim 15, wherein the target jet has a transverse diameter of 50 μm and the full width at half maximum of the electron beam is 24±2 μm, and the electron beam has a power of at least 63 W.

38. The system for generating x-ray radiation of claim 15, wherein the target jet has a transverse diameter of 50 μm and the full width at half maximum of the electron beam is 24±2 μm, and the electron beam has a power of 63 W.

39. The system for generating x-ray radiation of claim 15, wherein the target jet has a transverse diameter of 50 μm and the full width at half maximum of the electron beam is 24±2 μm, and the electron beam has a power of 72 W.

40. The system for generating x-ray radiation of claim 15, wherein the target jet has a transverse diameter of 50 μm and the full width at half maximum of the electron beam is 15.5±1.5 μm, and the electron beam has a power of 63 W.

41. The system for generating x-ray radiation of claim 15. wherein the target jet has a transverse diameter of 50 μm and the full width at half maximum of the electron beam is 15.5±1.5 μm, and the electron beam has a power of 72 W.

42. The system for generating x-ray radiation of claim 15, wherein the target jet has a transverse diameter of 30 μm and the electron beam has a power of 55 W.

43. The system for generating x-ray radiation of claim 15, wherein the target jet has a transverse diameter of 30 μm and the electron beam has a power of 38 W.

44. The system for generating x-ray radiation of claim 15, wherein the target jet has a transverse diameter of 30 μm and the electron beam has a power of 47 W.

45. The system for generating x-ray radiation of claim 15, wherein the target jet has a transverse diameter of 30 μm and the electron beam has a power of 78.5 W.

* * * * *